United States Patent [19]

McMahon et al.

[11] Patent Number: 4,922,470

[45] Date of Patent: May 1, 1990

[54] BARREL STAVE PROJECTOR

[75] Inventors: Garfield W. McMahon, Dartmouth; Dennis F. Jones, Halifax, both of Canada

[73] Assignee: Her Majesty the Queen in right of Canada, as represented by the Minister of National Defence of Her Majesty's Canadian Government, Ottawa, Canada

[21] Appl. No.: 271,466

[22] Filed: Nov. 15, 1988

[51] Int. Cl.[5] ..... H01V 7/00

[52] U.S. Cl. ..... 367/163; 367/159; 367/174; 310/337

[58] Field of Search ..... 367/159, 163, 174, 165, 367/173, 141, 158, 402; 310/337

[56] References Cited

U.S. PATENT DOCUMENTS

| | | | |
|---|---|---|---|
| 3,258,738 | 6/1966 | Merchant | 367/163 |
| 3,449,712 | 6/1969 | Angeloff | 367/159 |
| 4,706,230 | 11/1987 | Inoue et al. | 367/174 |

*Primary Examiner*—Charles T. Jordan
*Assistant Examiner*—J. Woodrow Eldred
*Attorney, Agent, or Firm*—Roylance, Abrams, Berdo & Goodman

[57] ABSTRACT

An underwater acoustical projector consisting of a spaced apart pair of polygonal shaped end plates, a ceramic driver of smaller cross-sectional size than each end plate, positioned between the end plates, and a set of staves secured from one end plate to the other, each stave being bent concavely inwardly towards the driver and being separated from each other by a gap.

20 Claims, 2 Drawing Sheets

BARREL STAVE PROJECTOR

This invention relates to a "barrel-stave" projector which efficiently generates high power underwater sound at low frequencies. The projector is also of small size, of light weight, and is capable of being produced at a low manufacturing cost.

It is known to construct underwater acoustic transducers using a flextensional concept such as that discussed in applied acoustics (3)(1970) Page 117 in an article by L. H. Royster entitled "The Flextensional Concept: A New Approach to the Design Of Underwater Acoustic Transducers". A transducer of this type consists of a ceramic piezoelectric, or piezo-magnetic driver, a mechanical shell and an internal and external fluid medium. The shell is slit lengthwise forming curved beams or staves. The name "flextensional" implies that the flexural vibration of the curved stave is driven by the extensional vibration of the piezoelectric, or piezo-magnetic, driver. The volume velocity of the vibrating stave is much greater than that available from the driver, and the resonance frequency is much lower.

However, such a known transducer is quite expensive to manufacture and not very amenable to mass production. Moreover, disassembly of the transducer for repair or for any other reason risks its complete destruction. There are various configurations produced utilizing the flextensional concept, and with some of these configurations, the hydrostatic pressure due to submergence tends to generate tensile stresses in the ceramic driver, which itself is very weak in tension.

In the present invention, the vibrating staves curve inwardly rather than the conventional outwardly. The ceramic driver that is utilized is a stack of rings coupled to stiff, flat end plates to which the staves are attached. The end plates are preferably polygonal and, after assembly, the outer surface of each of the staves could be machined so that the finished projector is of round cross-section between the end plates. This shape allows for the easy application of a tubular rubber boot for sealing purposes, such as waterproofing. If preferred, the driver and the end plates can be open to the medium (with suitable sealing) so that electrical and support cables can pass through the driver. This allows for a very compact unit.

The invention will now be described with reference to the accompanying drawings in which.

Figure 1A:
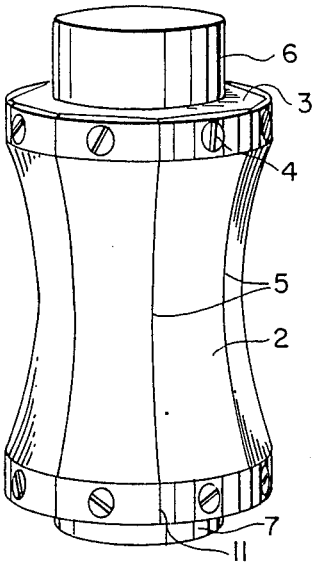
FIGS. 1A and 1B show two perspective views of a preferred embodiment of the barrel-stave projector of this invention without a rubber boot, with FIG. 1B having some of the staves removed to show the inner construction.
Figure 1B:
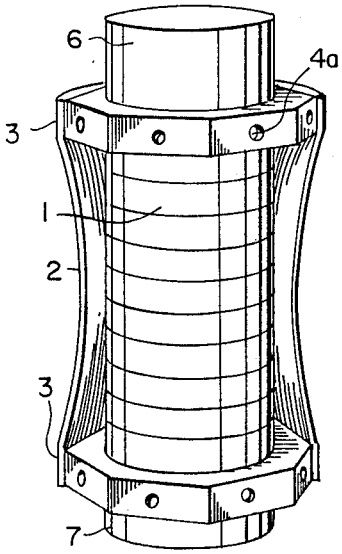

Referring to the drawings and in particular FIGS. 1A and 1B, the "barrel-stave" projector consists of a driver 1 manufactured from piezo-electric ceramic; an enclosure around the driver 1 which consists of staves 2, and two polygonal end plates 3. The end plates are shown specifically as being octagonal in this embodiment. The staves 2 are secured to the end plates 3 with an adhesive, one suitable adhesive being epoxy resin, and bolts 4, retained in threaded holes **4*a* in the end plates. The bolts have countersunk heads which recess into suitable countersunk holes in the staves so that the heads do not protrude above the general immediate surface level of the staves. Between adjacent staves there are gaps 5 which permits the staves to vibrate freely in flexure. If it is wished to close off the inside of the driver 1, end caps 6 and 7 can be used to cover openings in end plates 3. The end caps can be of any suitable design, being made to fit partly within each opening within the end plates, or being large enough to surround the opening. They may be sealed with O-rings or bonded to the end plates if disassembly is not a requirement. A single bolt (not shown) through the center of the driver can alternatively be utilized for pulling the end caps towards each other for sealing purposes. Note that no electrical wires or connections have been shown in FIGS. 1A and B**, but such wires could be passed through one of the end caps through a sealing grommet.

Figure 2:
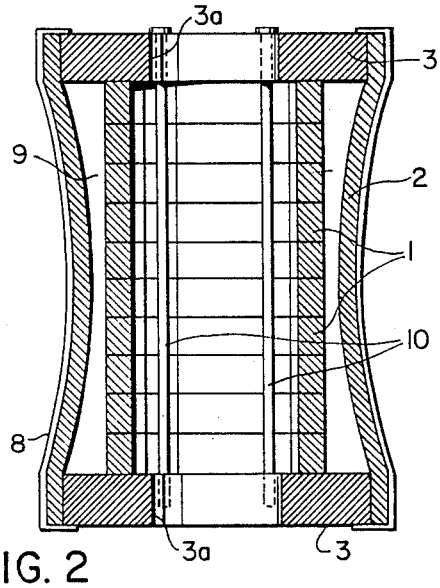
FIG. 2 is a cross-sectional view along a longitudinal axis of FIG. 1 with a rubber boot in place and without the upper and lower end caps of FIG. 1.
Figure 3:
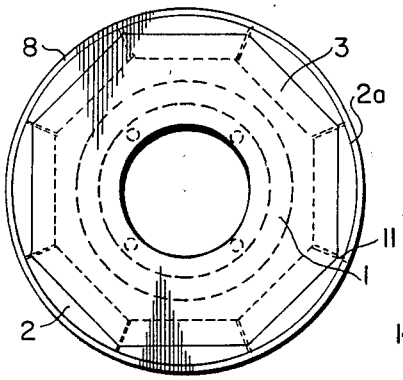
FIG. 3 is a plan view of the projector of FIG. 2.

Referring to FIGS. 2 and 3, the end plates 3 having opening **3*a* are clamped together across the ceramic driver 1 by relatively small bolts 10 which mainly serve as an assembly aid to provide ruggedness when handling during assembly. The end plates will normally be bonded to the ends of the ceramic driver 1. No electrical connections are shown in these Figures. Referring to FIG. 3, the outer surface of the staves is machined to form a circular cross-section throughout the length of the staves, and gaps 11 between the staves at the end regions only are filled with a potting plastic such as epoxy. A tubular rubber boot 8 is fitted over the stave section of the projector to prevent the external acoustic fluid from entering the space 9 between the staves and the driver 1. A light coating of ethylene glycol or other suitable liquid is wiped onto the staves before the boot is placed thereon, so that the boot 8** will be in good acoustical contact with the staves. The enhanced vibration amplitude of the staves is thus transformed into an enhanced volume velocity in the external acoustic fluid.

The projector of FIGS. 2 and 3 is a free flooding design, the interior of the driver 1 being open to the surrounding medium. Therefore a sealing coating will be required on the inner surface of the driver. If the surrounding medium is to be water, a suitable waterproofing coating could be applied to the inner surface of the driver. Alternatively, if the projector of FIG. 2 is not to be free flooding, a pair of simple end caps can be utilized such as those shown in FIGS. 1A and 1B.

Figure 4B:
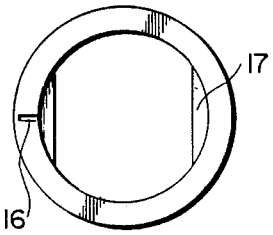
FIGS. 4A and 4B are cross-sectioned elevational and plan views of a ceramic stack piezo-electric driver for the projector, with the electrical connections shown schematically.
Figure 4A:
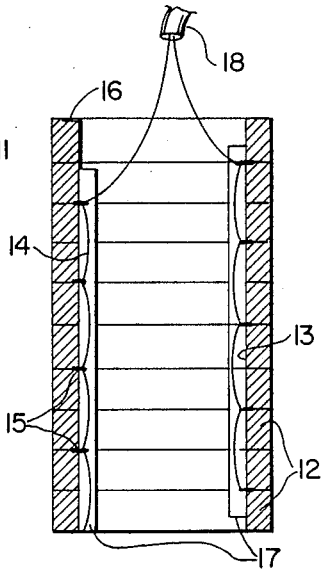

The driver 1 is shown in more detail in FIGS. 4A and 4B and is comprised of rings 12 of piezo-electric ceramic which will typically be a lead zirconate-titante material, each ring being plated on its flat surfaces with conductive electrodes and axially poled to render it piezo-electrically active. The rings 12 are bonded together by epoxy, or another suitable adhesive, in a cylindrical stack and connected electrically in parallel, by wire conductors 13 and 14. Short pins 15 are soldered or conductively cemented into notches 16 in the rings 12 and conductors 13 and 14 are then soldered to these pins. There are other methods of connecting the conductors to the rings, the method shown being only one of the preferred ways. The wiring harness is potted within a plastic 17, the plastic preferably being epoxy. This potting of the harness prevents the connections from suffering from fatigue failure which could be caused by the severe vibration conditions under which the driver operates. If the driver is to be free-flooded with water, the potting must be thicker than required if the driver is not to be free-flooded, and the potting should extend around the whole of the inner surface of the driver. The conductor 13 leads to the "high" side of an electrical cable 18, and conductor 14 leads to the "low" side, which is common to the metal parts of the projector. Therefore in the structure shown, connection to the "low" electrode of the upper ring of the driver can be made via the metal structure.

Figure 5A:
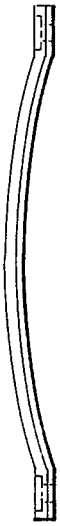
FIGS. 5A, 5B and 5C are side elevational, front elevational, and plan views of a single stave of the projector of FIG. 1.
Figure 5B:
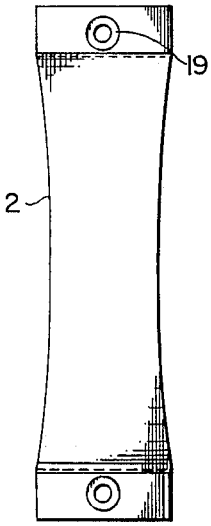
Figure 5C:
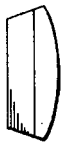

A single stave is shown in FIGS. 5A, 5B and 5C in its, as installed, shape. Countersunk holes 19 accommodate the heads of the bolts 4 and the outer surface of the staves is rounded to present a circular cross-section finished body.

This invention is restricted only by the scope of the claims which follow.

The embodiments of the invention in which an exclusive property or privilege is claimed are defined as follows:

1. An underwater acoustical projector, comprising a spaced apart pair of polygonal shaped end plates, a ceramic driver of smaller cross-sectional size than each end plate, positioned between the end plates, and a set of staves secured from one end plate to the other, each stave being bent concavely inwardly towards the driver and being separated from each other stave by a gap.

2. The projector of claim 1, wherein each stave is secured to the end plates by adhesive bonding and by a bolt screwed into each end plate.

3. The projector of claim 1, wherein each end plate has an aperture through its central region.

4. The projector of claim 1, wherein the driver is cylindrical and has an aperture therethrough along its longitudinal axis.

5. The projector of claim 4, wherein the driver is comprised of a set of annular rings.

6. The projector of claim 5, wherein each ring is plated on its flat surfaces with conductive electrodes and axially poled to render it piezo-electrically active.

7. The projector of claim 6, wherein each ring is bonded to the next ring and the assembled driver is bonded between the end plates.

8. The projector of claim 7, wherein electrical connectors are secured to each ring and electrical wiring from each connector is potted along the length of the driver within the longitudinal aperture.

9. The projector of claim 1, including a rubber boot externally covering the staves and part of each end plate.

10. The projector of claim 4, including a sealer coating inside the longitudinal aperture of the driver.

11. The projector of claim 1, including an end cap secured to each end plate to prevent the inside of the driver from being exposed to the outside medium.

12. The projector of claim 8, wherein the electrical wiring extends out through one of the end plates.

13. The projector of claim 12, wherein the electrical wiring passes through a sealing grommet in one of the end caps.

14. An underwater acoustical projector, comprising:

a pair of spaced apart, polygonal shaped, end plates;

a ceramic driver of smaller cross-sectional size than each end plate, positioned between the end plates; and a set of separate staves secured at each end thereof to one of the end plates, each stave being bent concavely inwardly towards the driver and being separated from adjacent staves by a gap extending the entire length of each stave from one end plate to the other end plate.

15. The projector of claim 14, wherein the driver is cylindrical, has an aperture therethrough along its longitudinal axis, and comprises a set of annular rings, each ring being plated on its flat surfaces with conductive electrodes, axially poled to render it piezo-electrically active and bonded to the next ring, the driver being bonded between the end plates; and wherein electrical connectors are secured to each ring and electrical wiring from each connector is potted along the length of the driver within the longitudinal aperture.

16. The projector of claim 14, wherein the electrical wiring extends out through one of the end plates.

17. The projector of claim 16, wherein the electrical wiring passes through a sealing grommet in one of the end caps.

18. The projector of claim 14, wherein a rubber boot externally covers the staves and part of each end plate.

19. The projector of claim 14, wherein a sealer coats inside the longitudinal aperture of the driver.

20. An underwater acoustical projector, comprising:

a pair of spaced apart, polygonal shaped, end plates;

a ceramic driver of smaller cross-sectional size than each end plate, positioned between the end plates, the driver being cylindrical, having an aperture therethrough along its longitudinal axis, and including a set of annular rings, each ring being plated on its flat surfaces with conductive electrodes, axially poled to render it piezo-electrically active and bonded to the next ring, the driver being bonded between the end plates;

electrical connectors secured to each ring and electrical wiring from each connector potted along the length of the driver within the longitudinal aperture; and staves secured at each end thereof to one of the end plates, each stave being bent concavely inwardly towards the driver and being separated from each other stave by a gap.

* * * * *